United States Patent [19]

Miyauchi et al.

[11] Patent Number: 4,624,807

[45] Date of Patent: Nov. 25, 1986

[54] PROCESS FOR PRODUCING MICROSPHERICAL, OIL-CONTAINING CARBONACEOUS PARTICLES

[75] Inventors: Terukatsu Miyauchi, Yokohama; Yoneichi Ikeda, Kamakura; Takao Nakagawa; Toshio Tsutsui, both of Ichikawa; Tatsuji Kikuchi, Tokyo, all of Japan

[73] Assignee: Fuji Standard Research Kabushiki Kaisha, Tokyo, Japan

[21] Appl. No.: 517,371

[22] Filed: Jul. 26, 1983

[30] Foreign Application Priority Data

Jul. 28, 1982 [JP] Japan ..... 57-130477

[51] Int. Cl.[4] ..... B29B 9/16

[52] U.S. Cl. ..... 264/12; 44/1 F; 201/6; 201/8; 201/42; 264/14; 264/15; 264/29.6; 264/29.7; 264/118; 264/121; 264/330

[58] Field of Search ..... 264/15, 29.6, 12, 14, 264/121, 118, 330, 144; 201/6, 8, 42; 44/1 F

[56] References Cited

U.S. PATENT DOCUMENTS

| | | | |
|---|---|---|---|
| 2,038,251 | 4/1936 | Vogt | 264/85 |
| 2,166,321 | 7/1939 | Pott | 264/105 |
| 3,197,413 | 7/1965 | Wingerd | 209/39 |
| 3,213,169 | 10/1965 | Kardaun et al. | 264/330 |
| 3,235,483 | 2/1966 | McCoy et al. | 208/39 |
| 3,350,295 | 10/1967 | Hamner et al. | 264/105 |
| 3,382,084 | 5/1968 | Folkins et al. | 264/105 |
| 3,554,716 | 1/1971 | West | 264/15 |
| 3,716,607 | 2/1973 | Otani | 264/29.6 |
| 3,869,302 | 3/1975 | Shea et al. | 264/12 |
| 4,002,533 | 1/1977 | Repik et al. | 201/8 |
| 4,002,535 | 1/1977 | Albright et al. | 201/42 |
| 4,009,232 | 2/1977 | Shiiki et al. | 264/9 |
| 4,111,755 | 9/1978 | Bon et al. | 44/1 F |
| 4,139,416 | 2/1979 | Palumbo et al. | 201/8 |
| 4,238,429 | 12/1980 | Sasaki et al. | 264/14 |
| 4,243,794 | 1/1981 | White et al. | 264/15 |
| 4,371,454 | 2/1983 | Hisatsugu et al. | 264/15 |

FOREIGN PATENT DOCUMENTS

| | | | |
|---|---|---|---|
| 0077691 | 11/1970 | German Democratic Rep. | 44/1 F |
| 0028300 | 9/1970 | Japan | 264/15 |
| 0008395 | 1/1978 | Japan | 44/1 F |
| 0034198 | 2/1982 | Japan | 44/1 R |
| 0986701 | 3/1964 | United Kingdom | 264/15 |
| 0787448 | 12/1980 | U.S.S.R. | 201/8 |

*Primary Examiner*—Jeffery Thurlow

*Attorney, Agent, or Firm*—Wyatt, Gerber, Shoup, Scobey and Badie

[57] ABSTRACT

A two-step process for producing microspherical pitch or green coke particles having an average diameter of 30–200 μm from finely divided petroleum or coal pitch having a softening point of 60°–220° C. and a fixed carbon content of 40–75 wt %. In the first step the material pitch is fluidized in the stream of a gas substantially inert to the pitch at a temperature of 100°–800° C., the mixed stream is rapidly cooled to 30°–400° C., and microspherical pitch particles are recovered with or without separate recovery of an oily product. In the second step the pitch spheres are further subjected to thermal cracking and polycondensation by use of a fluidized bed at a temperature of 350°–520° C. for a retention time of 1 min. to 3 hours, and microspherical green coke particles and a light cracked oil are recovered. In both steps a pressure between the ordinary level and 10 kg/cm$^2$ is used.

8 Claims, 1 Drawing Figure

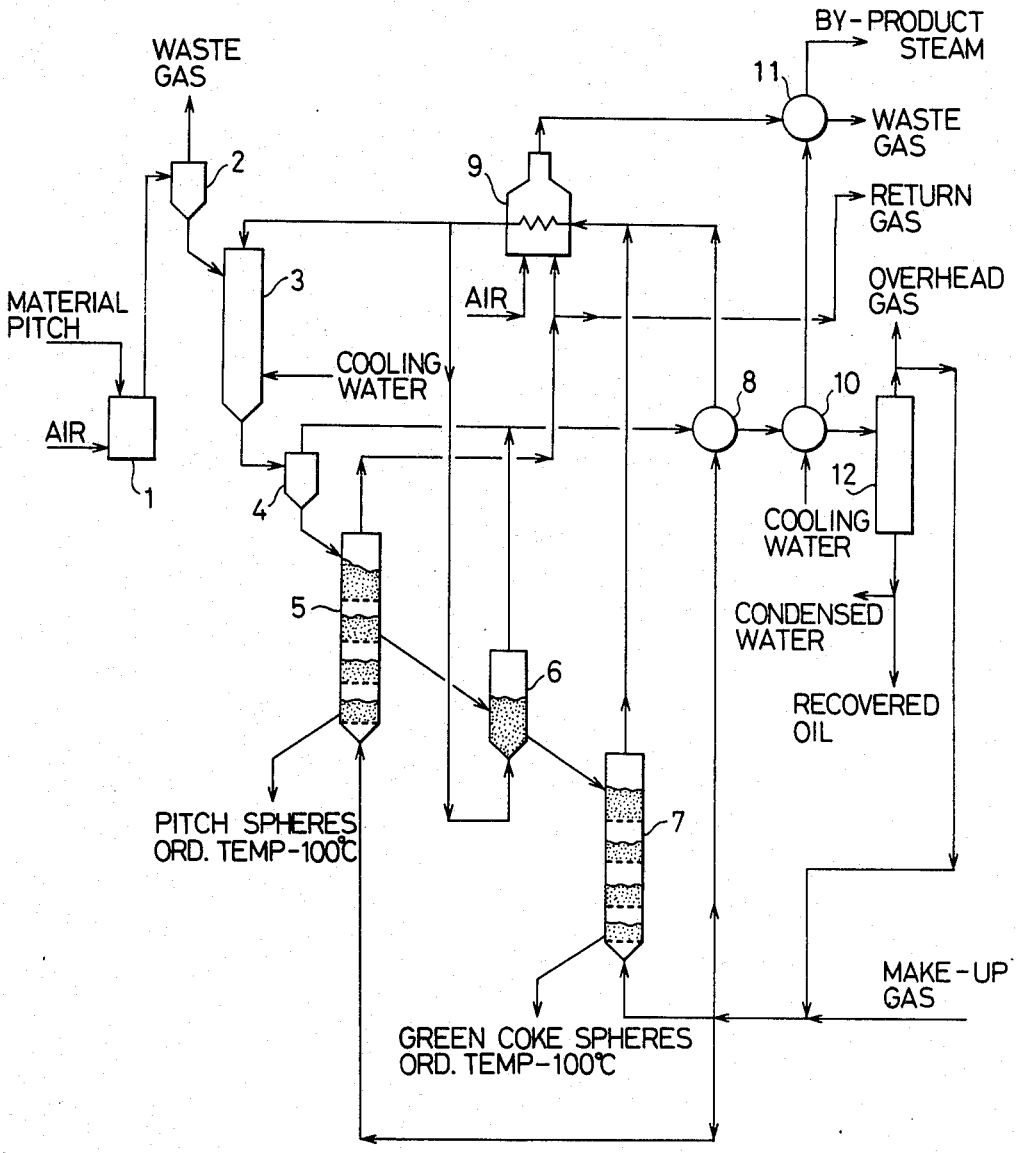
WASTE GAS
2
3
MATERIAL PITCH
AIR
1
COOLING WATER
4
5
6
7
PITCH SPHERES ORD. TEMP-100℃
GREEN COKE SPHERES ORD. TEMP-100℃
9
AIR
11
BY-PRODUCT STEAM
WASTE GAS
RETURN GAS
OVERHEAD GAS
8
10
12
COOLING WATER
CONDENSED WATER
RECOVERED OIL
MAKE-UP GAS

PROCESS FOR PRODUCING MICROSPHERICAL, OIL-CONTAINING CARBONACEOUS PARTICLES

BACKGROUND OF THE INVENTION

This invention relates to a process for producing microspherical pitch and green coke particles, and more specifically to a process for producing such microspherical pitch particles made of any of pitches from processes for treating petroleum, coal or the like, or from any of naturally occurring bitumens or asphalts, and which can be handled as easily as a fluid for convenience in transportation and storage.

Generally, pitch and raw or green coke are not readily distinguishable from each other from the compositional viewpoint. The same applies in this invention. The pitch and green coke spheres according to the invention overlap in their ranges of fixed carbon content and hydrogen-carbon ratio. Nevertheless, there are clear distinctions between the two in the manufacturing process (degrees of decomposition and polymerization) and in physical and chemical properties of the products. The two products are hereinafter referred to as pitch spheres and green coke spheres.

Pitches are available in abundance from the processes for treating and refining petroleum, coal and the like. For example, treatments of petroleum bottom (residual) oils, tar sands, and oil shales, and coal coking and liquefaction processes afford pitches. Besides, there occur bitumens and asphalts in nature. Part of these pitches is in use, after appropriate treatments, for varied applications, e.g., as electrode-, steel-, and other binder pitches, solid fuels such as electrode coke, carbonaceous and other coke fuels, and as feedstocks for fuel gas and hydrogen gas production.

However, as is well-known with the naturally occurring bitumens and asphalts, those pitches are either viscous liquids or solids which become viscous as the temperature rises. The inherent viscosities make them difficult to handle for transportation and storage, thus limiting their fully effective utilization.

The present invention provides novel, spherical pitch and green coke products which eliminate the disadvantages of the currently available products and permit easy handling like a fluid without adhesiveness. The pitch and green coke spheres, which are so easy to transport and store, are very helpful in settling the problems in processes for treating heavy distillates and bottoms to which increasing importance is being attached. Of the crude oils in production and on market, heavy ones are accounting for increasing percentages, while another general tendency is a gradual shift in demand from heavy to light and lighter petroleum products. Consequently, there is an urgent need for expanding the capacities of processes for converting and upgrading heavy or bottom oils to lighter materials. Additionally early development of substitute energies for petroleum is being called for. Attempts to recover oils from tar sands and oil shales and development of new coal liquefaction processes are also under way. Heavy distillates or oils from these sources are to be fed, too, to the heavy-to-light conversion and upgrading processes. Those processes naturally give carbonaceous residues, which present a number of handling and application problems yet to be solved with the existing installations for the heavy oil treating processes.

This will be explained, by way of example, in connection with typical processes for treating petroleum bottom oils, namely, delayed coking, Eureka process, Fluid Coking, and Flexicoking processes. Delayed coking, which is a semibatch process, produces residual green coke in coke drums which must be crushed and taken out at regular intervals by hydraulic or mechanical means. The crushed mass is difficult to discharge, and the product coke is inconvenient to transport and store because of its moisture and other contents. The product also involves difficulties in use as fuel. The Eureka process, again for semibatch operation, yields residual pitch in a liquid form, which can be continuously taken out and cooled solid by a flaker for use as binder for iron and steel. Although the residue the process gives is a pitch easy to take out, it still entails some inconvenience in transportation and storage. Moreover, in the present state of the art, there is a quantitative limit to the application of the pitch as the binder or the like. Fluid Coking gives coarse coke pieces as the residue, but because relatively high temperatures are used in processing, the coke has rather poor combustibility and hence its value as fuel is low. Flexicoking further gasifies the residual coke pieces obtained above. The gasified product is convenient for transportation but not for storage. In addition, the gas is low in calorific value and is limited in use as fuel.

The present inventors conceived the idea of continuously taking out of the system, in the form of pitch, the carbonaceous residue that results from a process of treating heavy residual bottoms, and then forming the pitch into microspherical pitch or green coke particles that can be handled like a fluid, in the belief that the product would then be convenient for transportation and storage, usable directly as fuel in many cases, and be efficiently gasifiable when necessary, thus contributing greatly to the utilization of the carbonaceous residues from the bottom treating processes that leave many problems yet to be solved. Intensive investigations based on the concept have now led to the provision of a process for producing pitch and green coke spheres capable of solving the problems pertaining to the bottom oil treating process.

BRIEF DESCRIPTION OF THE DRAWING

The single FIGURE is a process flow chart of an embodiment of the invention.

DETAILED DESCRIPTION OF THE INVENTION

The pitch spheres made in accordance with this invention are minute and are hardened by a surface treatment at least to such an extent that they do not stick to each other. Moreover, they are spherical in shape, and the mass of the spheres behaves like a fluid. Accordingly, they are characterized by ease of handling, transportation, and storage.

The pitch spheres are substantially free from moisture and, in many cases, low in ash content. They can, therefore, be fired directly without the need of pulverization as special fuel by a burner of a universal type through some modification of the spherical pitch properties. An additional advantage is that the combustibility can be controlled through adjustment of the oil (volatile) content of the pitch spheres.

Further, as will be described in detail later, thermal cracking of the spherical pitch by use of a fluidized bed or other similar technique will decompose part of its oil content to lighter products which are separable. The remainder is thermally polymerized to form green coke spheres. This product, having minute pores, can be employed directly as fuel, e.g., for kilns. It is easily gasified for use as fuel or as desirable feed for hydrogen gas production. The microspherical shape again renders the green coke spheres convenient for handling, transportation, and storage.

The pitch spheres of the invention are made from a material pitch having a softening point of 60°-220° C. and a fixed carbon content of 40-75 wt% by (1) atomizing the pitch to a microspherical form and (2) improving the surface physical properties of the resulting pitch spheres by evaporating the oily matter from the surface depending on the pitch condition or, where necessary, (3) slightly oxidizing the sphere surface, washing the spheres with a solvent or the like, or adding carbon black to them.

The pitch spheres thus formed have an average particle diameter (mean of 50% by weight) of 30-200 μm, oil content of 55-15 wt%, fixed carbon content of 45-85 wt% (as measured in conformity with the Japanese Industrial Standards M-8812), and softening point of not lower than 80° C. The product is in the form of practically nonadhesive particles.

The softening point given above, measured with a Shimadzu-Koka flow tester (manufactured by Shimadzu Seisakusho, Ltd.), indicates that the particles can retain their spherical form under compression of 1 $kg/cm^2$ at ordinary temperatures.

Generally, if the softening point is below 80° C. or the fixed carbon content is less than 45 wt%, the spheres will not have adequate properties for usual transportation and storage because of adhesiveness, inadequate strength, etc.

The compositional values, given in terms of the oil content, fixed carbon content, etc., of the pitch spheres are all average values. Individual particles may have a composition uniform throughout or may be ununiform in composition with a greater oil content (less fixed carbon content) in the center than in the periphery, as though having a spherical skin.

The green coke spheres of the invention are obtained by thermally cracking the pitch spheres, thereby converting the heavy oil content into a light one and then recovering the latter while polycondensing the remainder. Briefly, the green coke spheres of the invention are made from a pitch having a softening point of 60°-220° C. and a fixed carbon content of 40-75 wt% by (1) atomizing the pitch to a microspherical form, (2) allowing the oily matter to evaporate from the surface of the spherical pitch, (3) or, where necessary, effecting slight surface oxidation of the pitch spheres, washing with a solvent or the like, or adding carbon black or the like to improve the surface physical properties, and thereafter (4) performing thermal cracking. The coke spheres formed in this way have an average particle diameter in the range of 30-200 μm, oil content of 25-4 wt%, fixed carbon content of 75-96 wt%, and pore volume in excess of 0.05 cc/g.

If the spherical green coke produced has a fixed carbon content of less than 75 wt%, it will seldom possess adequate strength while retaining the pores. Conversely if the value exceeds 96 wt%, the product will not burn satisfactorily as a fuel.

Although the green coke spheres have a composition, as represented by the oil and fixed carbon contents, and an average particle diameter range in common, to some extent, with the pitch spheres, the former is more highly coked in the advanced stages of thermal cracking and polymerization. Especially, the coke spheres are distinctly different from the pitch spheres in that they have pores left behind by the evaporation from the inside of the light oil fractions formed by the thermal cracking.

For the pitch and green coke spheres the average diameter (mean of 50% by weight) is in the range of 30-200 μm.

If the diameter is less than 30 μm, the particles will tend to aggregate, especially in a fluidized state. If the diameter is above 200 μm, particularly where they flow together with the gas, the particles will exhibit inadequate smoothness, which is undesirable for transportation, storage, or fluidization.

The starting material for producing the pitch and green coke spheres of the invention may be any of the pitches from the petroleum thermal cracking processes and heavy bottom (residual) oil treating processes, e.g., Eureka process and solvent deasphalting (SDA) process, naturally occurring bitumens and asphalts and other petroleum pitches, coal pitches produced by coal coking and liquefying processes (e.g., SRC process), and various other pitches. The pitches to be used should have a softening point in the range of 60°-220° C., preferably in the range of 100°-180° C., and a fixed carbon content (as measured in conformity with JIS M-8812) of 40-75 wt%. Any material pitch with a softening point of lower than 60° C. and a fixed carbon content of less than 40% is not desirable as such because of its unfavorable effect upon the softening point of the resulting pitch spheres or upon the rigidity of the green coke spheres.

A typical method of producing the pitch spheres of the invention comprises grinding a solid pitch in a proper way at ordinary temperature, introducing the ground pitch into a hot gas at a temperature about 20° C. above the softening point of the material pitch, and thereafter cooling the resulting spherical pitch to obtain the objective pitch spheres.

In this way, the pitch spheres are obtained that have a softening point of over 80° C., maintain the spherical form at ordinary temperatures and at pressures up to 1 $kg/cm^2$, and are capable of remaining spherical without fusion in the temperature range of 350°-520° C. for the production of green coke spheres.

The green coke spheres of the invention are produced by thermally cracking the pitch spheres formed in the manner described above, at 350°-520° C. and at ordinary pressure to 10 $kg/cm^2$. The oily matter contained in the pitch spheres can be recovered by thermal cracking and conversion to a light oil while the remainder is subjected to polycondensation. With the progress of coking, the light oily matter evaporates, with the consequent formation of porous spheres of green coke.

For better understanding of the invention, the manufacturing process according to the invention will be described in more detail below with reference to a flow diagram in the accompanying drawing.

For the purposes of the invention, the process for producing the pitch spheres of the invention is hereinafter called the first step and that for producing the green coke spheres from the pitch spheres, the second step.

The first step consists in atomizing a hot, solid pitch into solid pitch spheres having nonadhesive, hardened surface, and recovering, where necessary, part of the heavy oil content from the material pitch.

Referring now to the drawing, a grinding mill 1 finely grinds lumps of material pitch in the presence of cooling gas, such as air at ordinary temperature, to a suitable particle size, while dissipating the heat generated by the grinding and keeping the particles from depositing on the walls.

The particle size of the finely ground pitch is predetermined in accordance with the size of the pitch spheres to be obtained. The former size should be somewhat larger than the latter to allow for some shrinkage of the material particles that is likely to take place.

The finely divided pitch is separated from air by a cyclone and bag filter 2 and fed to a heater 3.

The heater, usually a long, vertical cylinder, has from one to several inlets on the top for feeding the ground pitch and an additional inlet in the neighborhood for supplying a hot, inert gas. At the bottom of the heater is provided an outlet for discharging the resulting pitch spheres, inert gas, thermally cracked products, etc.

The hot gas, heated to 100°–800° C., preferably to 150°–600° C., by a heating furnace 9, is substantially inert to the pitch and comes into contact and mixes with the ground pitch, while descending through the heater at a velocity of 0.5–50 m/sec.

The inert gas temperature range of 100°–800° C. is desired because at below 100° C. the spherical formation of the pitch and the evaporation of oily matter take to much time and, besides, a large volume of gas is needed to economic disadvantage, whereas at above 800° C. the evaporation rate is too high to form pitch spheres of a desired shape. The ratio of the inert gas to the pitch spheres by weight is usually 0.1–15:1, preferably 0.2–8:1.

In this process heat is transferred from the hot gas stream to the finely divided pitch, melting the latter to liquid droplets. Under certain conditions part of the heavy oil contained in the liquid droplets is evaporated and diffused into the gas stream.

Consequently, the temperature of the mixed stream of the pitch and the inert gas drops, in many cases down to 100°–500° C. in about 10 seconds. The mixed stream is then rapidly cooled to solidify the pitch droplets, and the resultant is separated from the gas stream. Minute pitch spheres having an average particle diameter (mean of 50% by weight) of 30–200 μm are thus obtained. During this step, the recovery of heat from the pitch spheres and, where necessary, the heavy oil recovery from the gas stream are accomplished in appropriate ways.

Important parameters for the operation of the atomizer 3 include the inert gas temperature, supply ratio of the gas to the ground pitch, mixing conditions, retention time of the mixed stream, and temperature range for rapid cooling. Control of these parameters governs the fixed carbon content, average oil content, internal oily matter distribution, softening point (adhesiveness), and other properties of the resulting pitch spheres.

The rapid cooling of the pitch spheres is done, e.g., by spraying water or low-temperature gas into the mixed stream so as to lower its temperature to 30°–400° C. Alternatively, it can be accomplished by use of a multistage fluidized-bed type heat exchanger 5. The pitch spheres separated from the gas stream, e.g., by a cyclone 4, enter the fluidized-bed type exchanger 5, where the charge exchanges heat directly or indirectly with an incoming inert gas at ordinary temperature to 100° C. and usually at a velocity of 5–100 cm/sec, preferably 10–60 cm/sec. The spheres thus cooled to a temperature between the ambient and 100° C. are taken out of the vessel. The multistage fluidized-bed type heat exchanger may be replaced by a moving-bed type when desired.

Any oily matter present in the gas stream separated from the pitch spheres will be recovered by a distillation column 12 after the gas has been cooled by the passage through a suitable heat exchanger 8 and a cooler 10. The heat recovered by the exchanger 8 and the multistage fluidized-bed type heat exchanger 5 is utilized, in the embodiment shown, for heating the inert gas to achieve an improved thermal efficiency.

The pitch spheres so obtained are substantially nonadhesive and easy to handle, transport, and store. The product is not only suited as a special fuel or other applications but is also a feedstock for the production of green coke spheres in the second step of the process according to the invention.

Also, the recovered heavy oil content may be utilized as fuel, if necessary, after desulfurization or other treatment.

The second process step is, where desired, for producing green coke spheres. The step consists of recovering a relatively light oil by thermal cracking from the minute pitch spheres formed in the first step, and converting the remaining spherical particles into porous green coke spheres.

The pitch spheres from the first step are substantially nonadhesive particles containing, depending on the processing conditions used, 45–85 wt% fixed carbon and 55–15 wt% oily matter.

The pitch spheres obtained from the first step as the product or those extracted at a suitable temperature during the same step are fed to a fluidized-bed type thermal cracker 6 where coke particles are being fluidized with an inert gas, and they are thermally cracked therein in a fluidized state. The thermal cracking is performed at a temperature in the range of 350°–520° C., and at a pressure from ordinary up to 10 kg/cm$^2$, for an average retention time of one minute to three hours.

For the coke particles forming this fluidized bed the product obtained in the second step is used.

A polycondensation reaction that takes place concurrently with the thermal cracking in the second step converts the pitch spheres into green coke spheres. The latter attains greater strength thanks to the high fixed carbon content in the material pitch spheres and as a result of the polycondensation reaction during the course of cracking.

The green coke spheres hot from the fluidized-bed thermal cracker 6 are cooled, while the heat is removed, e.g., by a multistage fluidized-bed type heat exchanger 7, to be the final product. The flow rate of the inert gas in the multistage fluidized-bed and the like is usually 5–100 cm/sec, preferably 10–60 cm/sec. In the arrangement shown, the heat recovery from the multistage fluidized-bed type heat exchanger is effected by heat exchange with a low-temperature inert gas, and therefore the efficiency of heat utilization can be enhanced by conducting the inert gas to a heater 9.

Meanwhile, the cracked gas and cracked light oil from the cracker 6 are fed, together with the used inert gas from the atomizer, to the heat exchanger 8 and the cooler 10, and from the cooled gas its oily content is recovered by a distillation column 12. The light oil thus separated and recovered is desulfurized or otherwise treated to be a product. The cracked gas may be either treated together with the inert gas from the atomizer in the distillation column 12 as shown or, alternatively, separated in a separate distillation column to obtain a light oil.

The green coke spheres produced in the second step of the present process are microspherical, porous particles having an average diameter in the range of 30–200 μm, oil content of 25–4 wt%, and fixed carbon content of 75–96 wt%. The product is easy to handle, transport, and store, and is useful as a solid fuel and carbon material. Porosity helps its gasification for use as a gas fuel or material for producing hydrogen gas.

The quantitative proportions of the pitch spheres to be produced in the first step and the green coke spheres in the second step can be suitably altered depending on their markets (requirements).

The invention is illustrated by examples as follows:

EXAMPLE 1

A pitch obtained by thermally cracking a vacuum residue was used as the starting material. Its properties were as shown in Table 1.

TABLE 1

| | |
|---|---|
| Softening point, °C. | 146 |
| Oil content, wt % | 48.2 |
| Fixed carbon content, wt % | 51.8 |
| Elementary analysis, wt % | |
| C | 86.2 |
| H | 6.0 |
| N | 1.4 |
| S | 5.5 |
| H/C (atomic ratio) | 0.84 |

This material pitch was fed to the fine grinding mill at a rate of 30 kg/hr and was ground, while air at ordinary temperature was being supplied at a rate of 100 $Nm^3$/hr, to an average particle diameter of about 100 μm. The finely divided solids were collected by the cyclone and fed to the heater together with an inert gas at 500° C. The flow rate of the inert gas was 56 $Nm^3$/hr and the gas composition was as given in Table 2.

TABLE 2

| Analytical values, vol % | |
|---|---|
| $H_2$ | 5 |
| $CH_4$ | 45 |
| $C_2$ | 25 |
| $C_3$ | 20 |
| $C_4$+ | 5 |

The heater was in the form of a cylinder 500 mm in inside diameter and 2500 mm in length, having inlets formed at the top, one each, for supplying the finely ground pitch and the hot inert gas.

The introduction of the pitch into the inert gas lowered the mixed gas temperature to about 400° C. Further, with a spray of water at 25° C. at a rate of 10 kg/hr, the mixture was rapidly cooled down to about 70° C. The retention time required for the sphere making (heat transfer and evaporation) was about 0.5 second.

The mixed stream was separated by the cyclone separator into pitch spheres and gaseous matter. The pitch spheres were then routed to the multistage fluidized-bed cooler, where the pitch was cooled through contact with an inert gas at 30° C. introduced at the bottom of the fluidized-bed vessel, and a product at 45° C. was obtained.

The product pitch spheres had an average particle diameter of about 80 μm (the particles in the 40–150 μm range acc ounting for 90% of the total) and a softening point of not lower than 180° C. The particles at ordinary temperatures retained the spherical form under compression of 1 kg/$cm^2$. Table 3 gives the properties of the product.

TABLE 3

| | |
|---|---|
| Average oil content, wt % | 40 |
| Average fixed carbon, wt % | 60 |
| Elemental analysis (wt %) | |
| C | 86.6 |
| H | 5.4 |
| N | 1.4 |
| S | 5.8 |
| H/C (atomic ratio) | 0.78 |

The pitch spheres were taken out at a rate of 27 kg/hr, and the yield on the basis of the material pitch was 90 wt%.

On the other hand, the pitch spheres and the cyclonically separated gas stream were cooled by the heat exchanger and the cooler, and separated by the distillation column into recovered oil, condensed water, and off gas. The off gas was recycled as an inert gas through the heater for use in atomization. Part of the recycle was utilized as the coolant for the multistage fluidized-bed cooler.

The recovered oil separated by the distillation column was a heavy oil containing about 50% of fractions having boiling points of 540° C. or above. The yield was about 10 wt%.

The multistage fluidized-bed cooler was a four-stage type having an inside diameter of 210 mm and an effective height of 1000 mm.

EXAMPLE 2

With the same starting material and the same procedure as described in Example 1, pitch spheres were produced and separated from the gas stream by the cyclone. Next, from the second stage of the multistage fluidized-bed cooler, the pitch spheres were extracted (at 119° C.) and were thermally cracked by a single-stage fluidized-bed thermal cracker having an inside diameter of 210 mm and an effective height of 1000 mm, at a rate of 27 kg/hr. The thermal cracking temperature was 450° C., pressure was 0.3 kg/$cm^2$, and average reaction time was 0.5 hour. For the fluidized-bed formation the same inert gas as used for the atomization was utilized, at 600° C. The superficial velocity of the gas in the cracker was 0.15 m/sec. The green coke spheres obtained by the thermal cracking were cooled by contact with an inert gas at 40° C. introduced at the bottom of the mutlistage fluidized-bed cooler. The cooled spheres as the product were taken out at 65° C.

The product was microspherical green coke particles 85% of which was in the particle size range of 50–150 μm. Its properties were as shown in Table 4.

TABLE 4

| | |
|---|---|
| Average oil content, wt % | 13.4 |
| Average fixed carbon, wt % | 86.6 |
| Elemental analysis (wt %) | |
| C | 88.9 |
| H | 3.5 |
| N | 1.4 |
| S | 6.1 |
| H/C (atomic ratio) | 0.47 |
| Pore volume, cc/g | 0.30 |
| Compressive strength, kg/$cm^2$ | Over 15 |

The green coke spheres were obtained at a rate of 22 kg/hr, and the yield was 81.5 wt% based on the pitch sphere weight and about 73% of the starting pitch material.

Meanwhile, the cracked gas discharged from the fluidized-bed thermal cracker was cooled by the heat exchanger and the cooler, independently of the inert gas that left the atomizer and separated cyclonically from the pitch spheres. In the distillation column, it was separated into cracked oil, condensed water, and overhead gas. The overhead gas was recycled as an inert gas through the heating furnace for reuse as the atomizing gas or coolant for the multistage fluidized-bed cooler.

The cracked gas separated in the distillation column accounted for about 2.0 wt% of the starting pitch amount, and the cracked oil amounted to about 10 wt%, with properties as given in Table 5.

TABLE 5

| | | |
|---|---|---|
| Specific gravity | 15/4° C. | 0.913 |
| −235° C. | wt % | 22 |
| 235-540° C. | " | 75 |
| 540° C.− | " | 3 |

What is claimed is:

1. A process for the production of coke particles which comprises grinding a petroleum or coal pitch having a softening point in the range of 60° to 220° C. and a fixed carbon content of 40 to 70 wt % into finely divided pitch at a temperature at which said pitch remains in the solid state, introducing the finely divided pitch into a gas substantially inert to the pitch and at a temperature from 100° to 800° C. but at least about 20° C. above the softening point of the pitch, under a pressure from standard pressure to 10 Kg/cm$^2$ to form a pitch-gas mixed stream, rapidly cooling the mixture to a range of 30° to 400° C. but below the temperature of the mixed stream, and then recovering microspherical pitch particles and oil and converting the pitch particles to green coke particles by thermal cracking and polycondensation of the pitch spheres obtained in the first step in a fluidized bed at a temperature from 350° to 520° C., a pressure from the standard pressure to 10 Kg/cm$^2$ for an average retention time of one minute to three hours, and then separately recovering microspherical green coke particles and a light cracked oil.

2. A process according to claim 1, wherein the weight ratio of inert gas to pitch in the mixed stream is from 0.1:1 to 15:1.

3. A process according to claim 2, wherein the weight ratio is from 0.2:1 to 8:1.

4. A process according to claim 1, wherein the cooling of the spherical pitch particles is effected in a first fluidized heat exchanger by contacting the pitch particles with a fluidizing gas having a velocity of 5 to 100 cm/sec.

5. A process according to claim 1, wherein the recovering of the green coke particles includes a step of cooling said green coke particles in a second fluidized heat exchanger by contacting the green coke particles with a fluidizing gas having a velocity of 5 to 100 cm/sec.

6. A process according to claim 1, 2, 3, 4 or 5, wherein said finely divided solid pitch has a softening point from 100° to 180° C.

7. A process according to claim 1, 2, 3, 4 or 5, wherein said inert gas has a temperature from 150 to 600 C.

8. A process according to claim 1, 2, 3, 4 or 5, wherein said inert gas has a velocity of 0.5 to 50 m/sec.

* * * * *